US010172430B2

(12) United States Patent
Hsieh et al.

(10) Patent No.: US 10,172,430 B2
(45) Date of Patent: Jan. 8, 2019

(54) GEL NAIL PHOTOCURING MACHINE WITH MULTICOLOR LIGHT EFFECTS

(71) Applicant: COSMEX CO., LTD., New Taipei (TW)

(72) Inventors: Wan Chieh Hsieh, New Taipei (TW); Ya Wen Wu, New Taipei (TW); Yu Ching Li, New Taipei (TW); Wen Shan Chung, New Taipei (TW)

(73) Assignee: COSMEX CO. LTD., New Taipei (TW)

( * ) Notice: Subject to any disclaimer, the term of this patent is extended or adjusted under 35 U.S.C. 154(b) by 0 days.

(21) Appl. No.: 15/969,196

(22) Filed: May 2, 2018

(65) Prior Publication Data

US 2018/0325234 A1 Nov. 15, 2018

(30) Foreign Application Priority Data

May 11, 2017 (TW) ..... 106206709 U

(51) Int. Cl.
*A45D 29/00* (2006.01)
*H05B 37/02* (2006.01)
*H05B 33/08* (2006.01)

(52) U.S. Cl.
CPC ..... *A45D 29/00* (2013.01); *H05B 33/086* (2013.01); *H05B 37/0272* (2013.01); *A45D 2200/205* (2013.01)

(58) Field of Classification Search
CPC ..... A45D 29/00; F21Y 2113/10
USPC ..... 606/2; 607/88, 90; 40/581
See application file for complete search history.

(56) References Cited

U.S. PATENT DOCUMENTS

| | | | | |
|---|---|---|---|---|
| 9,713,371 | B1 * | 7/2017 | Luu | A45D 29/00 |
| 2011/0277338 | A1 * | 11/2011 | Li | F26B 3/28 34/275 |
| 2014/0124655 | A1 * | 5/2014 | Rivero | A45D 29/00 250/208.1 |
| 2017/0006993 | A1 * | 1/2017 | Rivero | A45D 29/00 |
| 2017/0127789 | A1 * | 5/2017 | Huang | H05B 37/0227 |
| 2017/0135173 | A1 * | 5/2017 | Huang | A45D 29/00 |

* cited by examiner

*Primary Examiner* — Thuy Vinh Tran
(74) *Attorney, Agent, or Firm* — Muncy, Geissler, Olds & Lowe, P.C.

(57) ABSTRACT

The present invention is to provide a gel nail photocuring machine with multicolor light effects, comprising: a machine body and a control module. The machine body has a curing cavity and one or a plurality of multicolor indicator light module provided on the machine body to produce color light effects on a housing of the machine body, wherein the multicolor indicator light module has a composite light source and a uniform illumination unit provided on one side of the composite light source. The control module is provided on the machine body and is connected to the multicolor indicator light module on the machine body, wherein the control module provides a color difference control instruction to the multicolor indicator light module according to a preset instruction in order to control an output power of each of a plurality of base-color light-emitting units of the composite light source, thereby instructing the multicolor indicator light module to emit light of various colors.

12 Claims, 4 Drawing Sheets

GEL NAIL PHOTOCURING MACHINE WITH MULTICOLOR LIGHT EFFECTS

BACKGROUND OF THE INVENTION

1. Technical Field

The present invention relates to a gel nail photocuring machine and more particularly to a gel nail photocuring machine with multicolor light effects.

2. Description of Related Art

Photocurable artificial fingernails are imitation fingernails formed by curing a photocurable gel with ultraviolet (UV) light. More specifically, a non-toxic natural photocurable resin is applied to a natural fingernail and then cured by irradiation such that a protective layer is formed on the surface of the natural nail. Apart from protecting the nail surface, the protective layer adds to the thickness and rigidity of the natural nail and helps correct the nail shape. The transparent or translucent resin also lends lucidity and charm to the natural nail.

The conventional gel nail photocuring machines are composed essentially of a machine body, a housing, a curing cavity in the housing, and an operation panel provided on the housing. To use such a gel nail photocuring machine, control instructions are input into the machine through the operation panel, which serves as a man-machine interface, and the working state of the machine (e.g., counting down, the current working mode, and the current light intensity) can be identified by the information displayed on the operation panel. While the gel nail photocuring machine is in operation, the user must pay close attention to, if not stare at, the information displayed on the operation panel in order to know the current working stage, and yet the limited size of the operation panel tends to cause eye strain. Besides, the exterior designs of the conventional gel nail photocuring machines are dull and lack variation.

BRIEF SUMMARY OF THE INVENTION

One objective of the present invention is to solve the aforesaid problems of the conventional gel nail photocuring machines, namely potential visual fatigue due to the need to look fixedly at the operation panel during operation and the tedious exterior designs of the machines.

To achieve the foresaid objective, the present invention provides a gel nail photocuring machine with multicolor light effects, comprising: a machine body and a control module. The machine body has a curing cavity and one or a plurality of multicolor indicator light module provided on the machine body to produce color light effects on a housing oldie machine body, wherein the multicolor indicator light module has a composite light source and a uniform illumination unit provided on one side of the composite light source. The control module is provided on the machine body and is connected to the multicolor indicator light module on the machine body, wherein the control module provides a color difference control instruction to the multicolor indicator light module according to a preset instruction in order to control an output power of each of a plurality of base-color light-emitting units of the composite light source, thereby instructing the multicolor indicator light module to emit light of various colors.

Further, the control module is connected to a plurality of ultraviolet light-emitting diode (UV LED) modules in the curing cavity to control an output power of the UV LED modules.

Further, the control module outputs color difference control instructions to the composite light source according to the output power of the one or the plurality of UV LED modules.

Further, the control module divides the total lighting duration of the one or the plurality of UV LED modules into several time periods and outputs corresponding color difference control instructions to the composite light source according to the corresponding time periods.

Further, the control module outputs corresponding color difference control instructions to the composite light source according to the working state of the machine body.

Further, the color difference control instruction comprises a plurality of target output power levels corresponding respectively to each of the composite light source; and when the composite light source receives a color difference control instruction, each of the light-emitting units of the composite light source is gradually modulated the output power from the starting output power level to the corresponding target output power level, respectively.

Further, the color difference control instruction comprises a plurality of target output power levels corresponding respectively to each of the composite light source; and when the composite light source receives a color difference control instruction, each of the light-emitting units of the composite light source is directly modulated the output power from the starting output power level to the corresponding target output power level.

Further, the composite light source is a red-green-blue (RGB) tri-color diode.

Further, the gel nail photocuring machine with multicolor light effects further comprises a wireless transmission module electrically connected to the control module so that the control module can couple with an electronic device through the wireless transmission module, allowing the electronic device to output corresponding control instructions to the control module and thereby control the lighting mode of the composite light source.

Further, the uniform illumination unit constitutes the housing of the machine body.

Further, the uniform illumination unit is fixed on the housing of the machine body.

Further, the uniform illumination unit is provided in an optical path of light emitted by the composite light source.

Therefore, the present invention has the following beneficial effects compared with the prior art:

1. The multicolor indicator light module in the present invention can change its light colors in response to the working state of a gel nail photocuring machine and thereby provide function indication through a variety of color light effects, allowing a user to blow the current working state of the gel nail photocuring machine in an interesting manner.

2. The multicolor indicator light module in the present invention helps inform a gel nail photocuring machine user of the current output power, lighting stage, and working mode of the ultraviolet light-emitting diode (UV LED) modules so that the working state of the machine can be known without the user having to stare at the operation panel.

DETAILED DESCRIPTION OF THE INVENTION

The details and technical solution of the present invention are hereunder described with reference to accompanying drawings. For illustrative sake, the accompanying drawings are not drawn to scale. The accompanying drawings and the scale thereof are not restrictive of the present invention.

Figure 1:
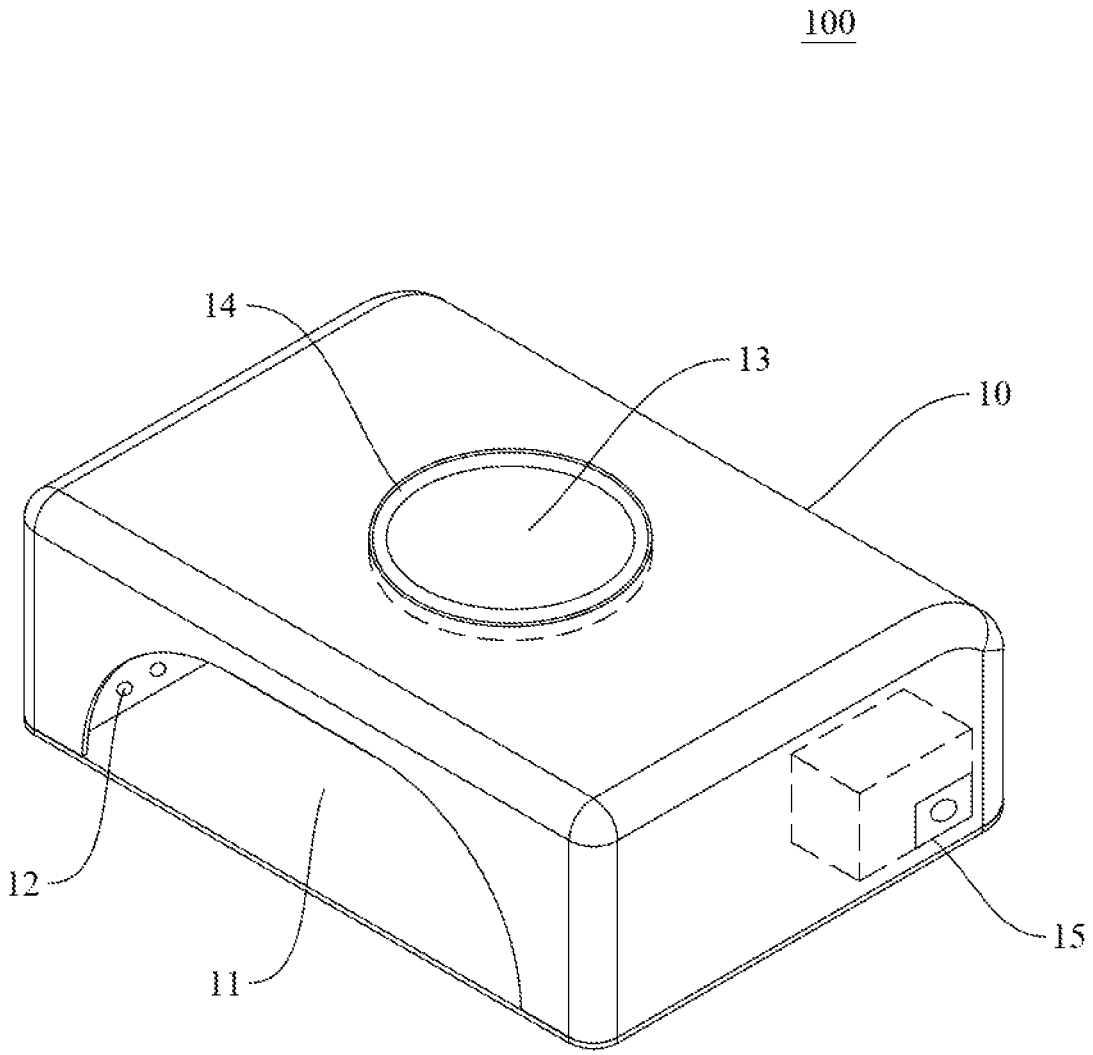
FIG. 1 shows an external perspective schematic view of a gel nail photocuring machine with multicolor light effects according to the present invention.
Figure 2:
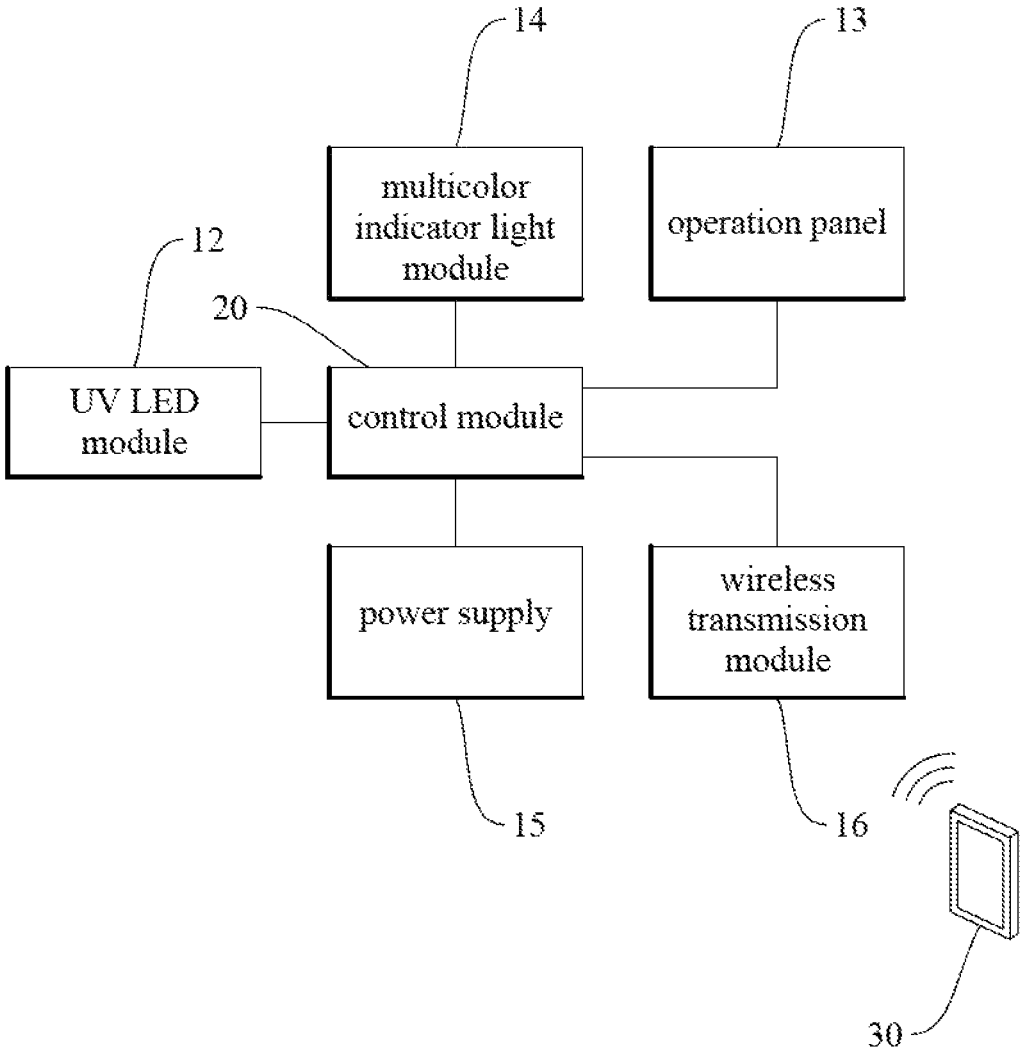
FIG. 2 shows a block diagram of a gel nail photocuring machine with multicolor light effects according to the present invention.

Please refer to FIG. 1 and FIG. 2 respectively for a perspective view and a block diagram of a gel nail photocuring machine according to the present invention.

As shown in FIG. 1 and FIG. 2, a gel nail photocuring machine 100 with multicolor light effects essentially includes a machine body 10 and a control module 20 provided on the machine body 10. The machine body 10 includes a curing cavity 11, one or a plurality of UV LED modules 12 provided in the curing cavity 11, an operation panel 13 provided on the machine body 10, one or a plurality of multicolor indicator light modules 14 provided on the machine body 10 to produce various color light effects on the housing of the machine body 10, a power supply 15 for providing electricity to the aforementioned devices, and other devices (e.g., an optical shutter and a heat dissipation plate, not shown) applicable to the machine body 10.

The control module 20 is connected to the one or the plurality of UV LED modules 12, the operation panel 13, and the one or the plurality of multicolor indicator light modules 14 in order to control, or receive instructions through, the foregoing devices. In one preferred embodiment, the control module 20 is a micro control unit (MCU) provided on a circuit board (not shown), and the circuit board has a plurality of expansion ports through which the control module 20 can connect with other devices on the machine body 10. In another preferred embodiment, some of the devices of the gel nail photocuring machine 100 are provided on the aforesaid circuit board and are connected to the MCU through circuits on the circuit board. The present invention has no limitation on the configuration of the control module 20. Instead of an MCU, the control module 20 may be a digital signal processor (DSP), a switch controller, or other commercial processors; the present invention has no limitation in this regard.

The operation panel 13 may include a display and one or a plurality of press-key. The display can be used to display the working state of the gel nail photocuring machine 100 (e.g., the current working mode of the gel nail photocuring machine 100, the measurement of curing time, the output power of the one or the plurality of UV LED modules 12, and the color mode of the one or the plurality of multicolor indicator light modules 14). The one or the plurality of press-keys can be used to turn on and off the gel nail photocuring machine 100, change the working mode or settings of the gel nail photocuring machine 100, or control the lighting mode of the one or the plurality of multicolor indicator light modules 14. The display may be a liquid crystal display or a digital display, and the one or the plurality of press-keys may be one or a plurality of physical press-keys or touch control press-keys; the present invention has no limitation in this regard. In one preferred embodiment, the display is constructed together with the one or the plurality of press-keys to form a touchscreen, but the present invention does not require that the display and the one or the plurality of press-keys be so configured.

Aside from operating the gel nail photocuring machine 100 through the operation panel 13, the gel nail photocuring machine 100 may further include and be operated via a wireless transmission module 16. The wireless transmission module 16 is electrically connected to the control module 20 so that the control module 20 can couple with an electronic device 30 through the wireless transmission module 16, allowing the electronic device 30 to output control instructions to the control nodule 20 and thereby control the lighting mode of the one or the plurality of multicolor indicator light modules 14, turn on and off the gel nail photocuring machine 100, or change the working mode or settings of the gel nail photocuring machine 100. The wireless transmission module 16 may be an infrared transceiver, a Bluetooth module, a Wi-Fi transmission module, a radio frequency identification (RFID) module, or the like; the present invention has no limitation in this regard. The electronic device 30 may be a remote control, a smart mobile device, a smart wearable device, a mainframe computer, a laptop computer, or the like; the present invention has no limitation in this regard, either.

The structural details and various aspects of the one or the plurality of multicolor indicator light modules 14 are explained below with reference to FIG. 3, which shows a partial sectional view of the disclosed gel nail photocuring machine with multicolor light effects.

Figure 3:
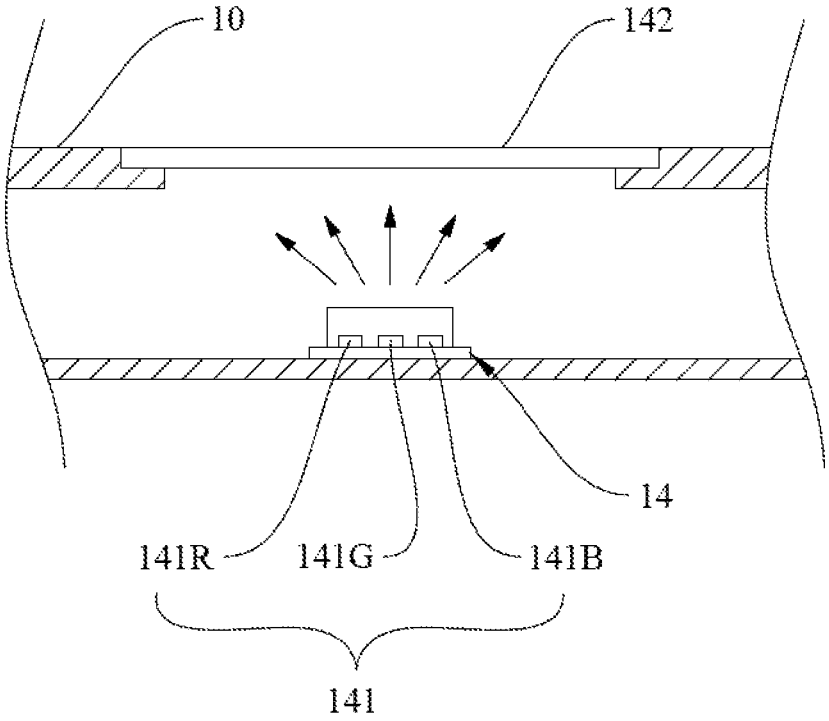
FIG. 3 shows a partial sectional schematic view of a gel nail photocuring machine with multicolor light effects according to the present invention.

As shown in FIG. 3, the multicolor indicator light module 14 is provided on the machine body 10 to produce various color light effects on the housing of the machine body 10. The multicolor indicator light module 14 may be fixed on an inner housing portion or an outer housing portion of the machine body 10 and be either exposed through or covered by the outer housing portion to facilitate production of the color light effects. In order to show various colors, the multicolor indicator light module 14 has a composite light source 141. By adjusting the power of each of the different-color light-emitting units of the composite light source 141, the light emitted by the multicolor indicator light module 14 can be rendered into different colors. In addition, a uniform illumination unit 142 is provided in the optical path of the light emitted by the composite light source 141 and is configured to diffuse and combine the light beams projected from the light-emitting units to enable the intended multicolor effects. It should be pointed out that the aforesaid optical path neither has a specific angle nor necessarily corresponds to the front side of the light-emitting units; the optical path refers to any line of sight along which the light of the light-emitting units can be seen. In one preferred embodiment, the composite light source 141 is a red-green-blue (RGB) tri-color diode, and by adjusting the light emission power of each of its red LED emitter 141R, green LED emitter 141G, and blue LED emitter 141B, different light colors can be achieved through color combination. The uniform illumination unit 142 may be a translucent plastic plate added with a diffusing agent, a frosted plastic plate, or a plastic plate with a plurality of microstructures on the surface to diffuse light; the present invention has no limitation on the configuration of the uniform illumination unit 142. In this embodiment, the uniform illumination unit 142 is provided on the housing of the machine body 10 in an annular manner to match the annular configuration of the composite light source 141 and hence of the multicolor effects to be produced (see FIG. 1). In one preferred embodiment, the control module 20 is provided on a circuit board, and the composite light source 141 is also provided on the circuit board and is electrically connected to the control module 20 through circuits on the circuit board.

The shape of the uniform illumination unit 142 may be different from that described above. For example, the uniform illumination unit 142 may be circular, oblong, polygonal, or irregular in shape; the present invention has no limitation in this regard. In one preferred embodiment, the uniform illumination unit 142 is implemented as the housing of the machine body 10 such that the uniform illumination unit 142 and the machine body 10 appear to form a single unit. The present invention, however, does not require that the uniform illumination unit 142 and the machine body 10 be so configured.

The working mode of the one or the plurality of multicolor indicator light modules 14 is explained below with reference to FIG. 4, which shows a block diagram of a disclosed multicolor indicator light module and the control module.

Figure 4:
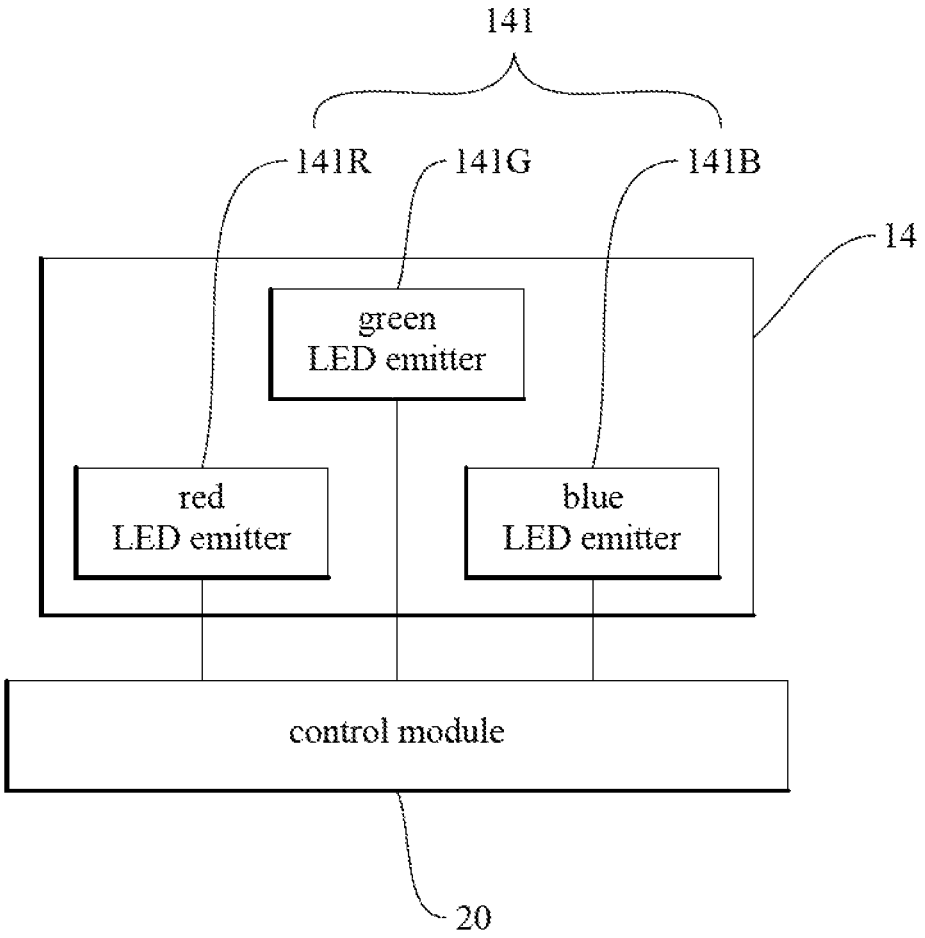
FIG. 4 shows a block diagram of the multicolor indicator light module and the control module according to the present invention.

Referring to FIG. 4, the control module 20 controls the operation of the multicolor indicator light module 14 by carrying out different color rendering modes according to the function blocks stored in a storage unit. More specifically, the control module 20 provides a color difference control instruction to the multicolor indicator light module 14 according to the preset instruction in each function block and thereby instructs the base-color light-emitting units of the composite light source 141 to generate light of different colors. Take the aforesaid RGB tri-color LED composite light source 141 for example. The red LED emitter 141R, the green LED emitter 141G, and the blue LED emitter 141B correspond to three different base colors respectively. By adjusting the output power of each of the three base colors to different values, a variety of colors can be obtained through color combination.

The multicolor indicator light module 14 can switch between the following modes as indicated by the function blocks. The control modes described below, however, are only exemplary. It is understood that the disclosed control modes can be modified or changed without departing from the main technical concept of the present invention, and that all such modifications and changes should fall within the scope of the invention.

In one function mode, the control module 20 outputs color difference control instructions to the composite light source 141 according to the output power of the one or the plurality of UV LED modules 12. More specifically, the control module 20 is triggered by the output power of the one or the plurality of UV LED modules 12. When the output power of the one or the plurality of UV LED modules 12 passes the threshold of a certain range of values, a color difference control instruction corresponding to the value range where the output power lies is provided by the control module 20 to the composite light source 141, in order for the composite light source 141 to generate a different color. Thus, the control module 20 can switch the light color of the multicolor indicator light module 14 in response to the temperature felt by a user's finger(s).

For example, the control module 20 is set with a high-output-power value range and threshold, a general-output-power value range and threshold, and a low-output-power value range and threshold according to the output power of the one or the plurality of UV LED modules 12. When the output power of the one or the plurality of UV LED modules 12 passes the threshold of, and thus enters, the high-output-power value range, the control module 20 is triggered to provide a first color difference control instruction to the multicolor indicator light module 14 such that the multicolor indicator light module 14 emits light of a first color (e.g., red). When the output power of the one or the plurality of UV LED modules 12 passes the threshold of, and thus enters, the general-output-power value range, the control module 20 is triggered to provide a second color difference control instruction to the multicolor indicator light module 14 such that the multicolor indicator light module 14 emits light of a second color (e.g., blue). When the output power of the one or the plurality of UV LED modules 12 passes the threshold of, and thus enters, the low-output-power value range, the control module 20 is triggered to provide a third color difference control instruction to the multicolor indicator light module 14 such that the multicolor indicator light module 14 emits light of a third color (e.g., green). The foregoing changes in color not only match the temperature variation of the gel nail photocuring machine 100 as perceived by a user's finger(s), but also allow the user to visually identify the current output power of the gel nail photocuring machine 100.

In another function mode, the control module 20 divides the total lighting duration of the one or the plurality of UV LED modules 12 into several time periods and outputs color difference control instructions to the composite light source 141 according to the time periods. More specifically, the control module 20 has a timer. When triggered by the operation panel 13, the electronic device 30, or an optical shutter to perform a timed lighting function, the control module 20 activates the one or the plurality of UV LED modules 12 and begins to time the emission of light. Once the time of the timer reaches a preset value (e.g., 30 seconds), the control module 20 is triggered to turn off the one or the plurality of UV LED modules 12. Moreover, as soon as the timed lighting function is triggered, the control module 20 can start outputting sequentially to the composite light source 141 the color difference control instructions corresponding respectively to the different time periods of the total lighting duration so that the light color corresponding to one time period is different from that corresponding to the next. For example, the preset 30-second duration of a timed lighting session is divided into three time periods: the $0^{th}$ second~the $10^{th}$ second, the $10^{th}$ second~the $20^{th}$ second, and the $20^{th}$ second~the $30^{th}$ second; and as time progresses, the control module 20 changes the light color of the composite light source 141 from a first color (e.g., dark purple) through a second color (e.g., purple) to a third color (e.g., light purple), allowing the user to blow the progress of the lighting session through the changes of color. In another preferred embodiment the total lighting duration is divided into shorter time periods so that the light color changes in a more continuous and more dynamic manner.

In yet another function mode, the control module 20 outputs color difference control instructions to the composite light source 141 according to the working state of the machine body 10. For example, as soon as the gel nail photocuring machine 100 is started, the control module 20 provides a first color difference control instruction to the composite light source 141 and thereby instructs the composite light source 141 to output light of a first color (e.g., white), indicating that the gel nail photocuring machine 100 is activated. When the gel nail photocuring machine 100 is left unused for a while and therefore switched to a standby state, the control module 20 provides a second color difference control instruction to the composite light source 141 and thereby instructs the composite light source 141 to output light of a second color (e.g., yellow), indicating that the gel nail photocuring machine 100 is now in the standby state.

In order for the multicolor indicator light module 14 to change light colors in a continuous and dynamic fashion without abrupt color changes or flashes, both of which may cause an uncomfortable sensation, the control module 20 in a preferred embodiment is set with target output power levels corresponding respectively to the light-emitting units of the composite light source 141. When the composite light source 141 receives a color difference control instruction, the control module 20 is actually instructing each of the light-emitting units of the composite light source 141 to start operation at a starting output power level and then gradually modulating the output power of each light-emitting unit to the corresponding target level. The modulation can be carried out by an independent pulse width modulator (PWM) or a PWM constructed together with the control module 20, with a view to a gradual change in color. In another preferred embodiment, and by way of example only, the output power of the composite light source 141 is directly adjusted from the starting level to the target level when receiving a color difference control instruction.

As above, the multicolor indicator light module in the present invention can change its light colors in response to the working state of a gel nail photocuring machine and thereby provides function indication through a variety of color light effects, allowing a user to know the current working state of the gel nail photocuring machine in an interesting manner. The multicolor indicator light module in the present invention helps inform a gel nail photocuring machine user of the current output power, lighting stage, and working mode of the ultraviolet light-emitting diode (UV LED) modules so that the working state of the machine can be frown without the user having to stare at the operation panel.

While the present invention has been described in connection with certain exemplary embodiments, it is to be understood that the invention is not limited to the disclosed embodiments, but, on the contrary, intended to cover various modifications and equivalent arrangements included within the spirit and scope of the appended claims and equivalents thereof.

What is claimed is:

1. A gel nail photocuring machine with multicolor light effects, comprising:

a machine body having a curing cavity and one or a plurality of multicolor indicator light modules provided on the machine body to produce color light effects on a housing of the machine body, wherein the one or each of the plurality of multicolor indicator light modules has a composite light source and a uniform illumination unit provided on one side of the composite light source; and a control module provided on the machine body and connected to the multicolor indicator light module on the machine body, wherein the control module provides a color difference control instruction to the one or the plurality of multicolor indicator light modules according to a preset instruction in order to control an output power of each of a plurality of base-color light-emitting units of the composite light source, thereby instructing the one or the plurality of multicolor indicator light modules to emit light of various colors.

2. The gel nail photocuring machine with multicolor light effects of claim 1, wherein the composite light source comprises a plurality of ultraviolet light-emitting diodes (UV LEDs), and the control module is connected to the plurality of ultraviolet light-emitting diode (UV LEDs) modules in the curing cavity to control an output power of the UV LED modules.

3. The gel nail photocuring machine with multicolor light effects of claim 2, wherein the control module outputs color difference control instructions to the composite light source according to the output power of the plurality of UV LED modules.

4. The gel nail photocuring machine with multicolor light effects of claim 2, wherein the control module divides the total lighting duration of the plurality of UV LEDs modules into several time periods and outputs corresponding color difference control instructions to the composite light source according to the corresponding time periods.

5. The gel nail photocuring machine with multicolor light effects of claim 1, wherein the control module outputs corresponding color difference control instructions to the composite light source according to the working state of the machine body.

6. The gel nail photocuring machine with multicolor light effects of claim 1, wherein the color difference control instruction comprises a plurality of target output power levels corresponding respectively to each of the composite light sources; wherein each of the composite light sources comprises a plurality of light-emitting units; and when the composite light source receives the color difference control instruction, each of the plurality of light-emitting units of the composite light source is gradually modulated the output power from a starting output power level to a corresponding target output power level, respectively.

7. The gel nail photocuring machine with multicolor light effects of claim 1, wherein the color difference control instruction comprises a plurality of target output power levels corresponding respectively to each of the composite light sources; wherein each of the composite light sources comprises a plurality of light-emitting units; and when the composite light source receives the color difference control instruction, each of the plurality of light-emitting units of the composite light source is directly modulated the output power from a starting output power level to a corresponding target output power level.

8. The gel nail photocuring machine with multicolor light effects of claim 1, wherein the composite light source is a red-green-blue (RGB) tri-color diode.

9. The gel nail photocuring machine with multicolor light effects of claim 1, further comprises a wireless transmission module electrically connected to the control module so that the control module can couple with an electronic device through the wireless transmission module, allowing the electronic device to output corresponding control instructions to the control module and thereby control a lighting mode of the composite light source.

10. The gel nail photocuring machine with multicolor light effects of claim 1, wherein the uniform illumination unit constitutes the housing of the machine body.

11. The gel nail photocuring machine with multicolor light effects of claim 1, wherein the uniform illumination unit is fixed on the housing of the machine body.

12. The gel nail photocuring machine with multicolor light effects of claim 1, wherein the uniform illumination unit is provided in an optical path of light emitted by the composite light source.

* * * * *